United States Patent [19]

Ragland, III

[11] 4,128,346

[45] Dec. 5, 1978

[54] DAISY TYPE PRINT WHEEL APPARATUS

[75] Inventor: Evan L. Ragland, III, Atherton, Calif.

[73] Assignee: Periphonics Corporation, San Carlos, Calif.

[21] Appl. No.: 795,799

[22] Filed: May 11, 1977

[51] Int. Cl.[2] ..... B41J 1/30

[52] U.S. Cl. ..... 400/144.2; 400/320

[58] Field of Search ..... 197/18, 53, 54, 82, 197/89; 64/28 M; 101/93.15–93.19, 99; 310/103

[56] References Cited

U.S. PATENT DOCUMENTS

| | | | |
|---|---|---|---|
| 2,929,477 | 3/1960 | Rodriguez et al. | 64/28 M |
| 3,227,258 | 1/1966 | Pannier et al. | 197/54 X |
| 3,384,216 | 5/1968 | Thayer | 197/18 |
| 3,677,386 | 7/1972 | Herterich et al. | 197/53 |
| 3,908,809 | 9/1975 | Beattie | 197/18 |
| 3,977,317 | 8/1976 | Delligatti | 101/35 |
| 4,026,403 | 5/1977 | Inose et al. | 197/53 |

OTHER PUBLICATIONS

IBM Tech. Disc. Bulletin, by P. Gmeiner, vol. 4, No. 1, Jun. 1961, pp. 8–9.

IBM Tech. Disc. Bulletin, by D. J. Wanek, vol. 15, No. 10, Mar. 1973, pp. 3227–3228.

IBM Tech. Disc. Bulletin, by K. V. Bostwich et al., vol. 8, No. 12, May 1966, p. 1822.

*Primary Examiner*—Paul T. Sewell

*Attorney, Agent, or Firm*—Flehr, Hohbach, Test, Albritton & Herbert

[57] ABSTRACT

Printing apparatus uses a daisy type print wheel which is continuously driven through a magnetic clutch arrangement. Characters are selected by actuation of either an electromagnetic brake acting on the print wheel or a toothed character selector acting on the spokes of the print wheel. When a character is selected and the print wheel is stopped, rotation of the motor continues because of the slippage of the magnetic clutch. Other features of the invention include a fast recovery time for the hammer because of its constant rate of actuation, a change in spacing by varying this constant rate and also an improved carriage scan technique which provides for fast return.

15 Claims, 12 Drawing Figures

DAISY TYPE PRINT WHEEL APPARATUS

BACKGROUND OF THE INVENTION

The present invention is directed to a daisy type print wheel apparatus and more specifically to the technique of driving and stopping the print wheel.

A typical daisy wheel printer is shown in U.S. Pat. No. 3,954,163 where a servo system stops the print wheel at each printing position and allows a hammer to strike the printing element. However, feedback control or servo systems are relatively expensive.

Other more mechanical techniques of stopping the daisy type printing wheel momentarily while the hammer is striking the wheel are illustrated in three other patents. Herterich Pat. No. 3,677,386 drives the print wheel by a crown gear arrangement and when the hammer engages the tongue of the daisy type print wheel the crown gear is withdrawn from driving a relationship with the print wheel. In a German Pat. No. 1,461,514 OLS the print elements are on the periphery of a disk and there is some type of spring-like clutch element between a drive shaft and a print shaft in a complex mechanical arrangement. Here apparently the ribbon is pressed against the type wheel to produce an impression. Finally in Hugel U.S. Pat. No. 3,353,647 a light friction motor normally rotates the daisy type print wheel with the wheel being stopped by some type of mechanical interference relationship.

All of the above three devices are mechanically cumbersome and will not provide high speed and accurate placement of the typed characters.

OBJECTS AND SUMMARY OF THE INVENTION

It is therefore an object of the invention to provide an improved printing apparatus utilizing a daisy type print wheel.

In accordance with the above object there is provided printing apparatus with a daisy type print wheel including a fixed portion of magnetic material. Means rotate the wheel around its axis including coaxial drive shaft means. Magnet means for producing a magnetic field are mounted for rotation with the drive shaft means and the wheel. Brake means act on the wheel for stopping its rotation. Magnetic material means are connected and rotatable with the drive shaft means and juxtaposed with the magnet means and the fixed wheel portion in a physical relationship to provide a substantial magnetic coupling force between the wheel and the drive shaft means. This allows the wheel and shaft means to have relative rotary motion therebetween when the brake means is actuated.

DETAILED DESCRIPTION OF THE PREFERRED EMBODIMENTS

Figure 1:
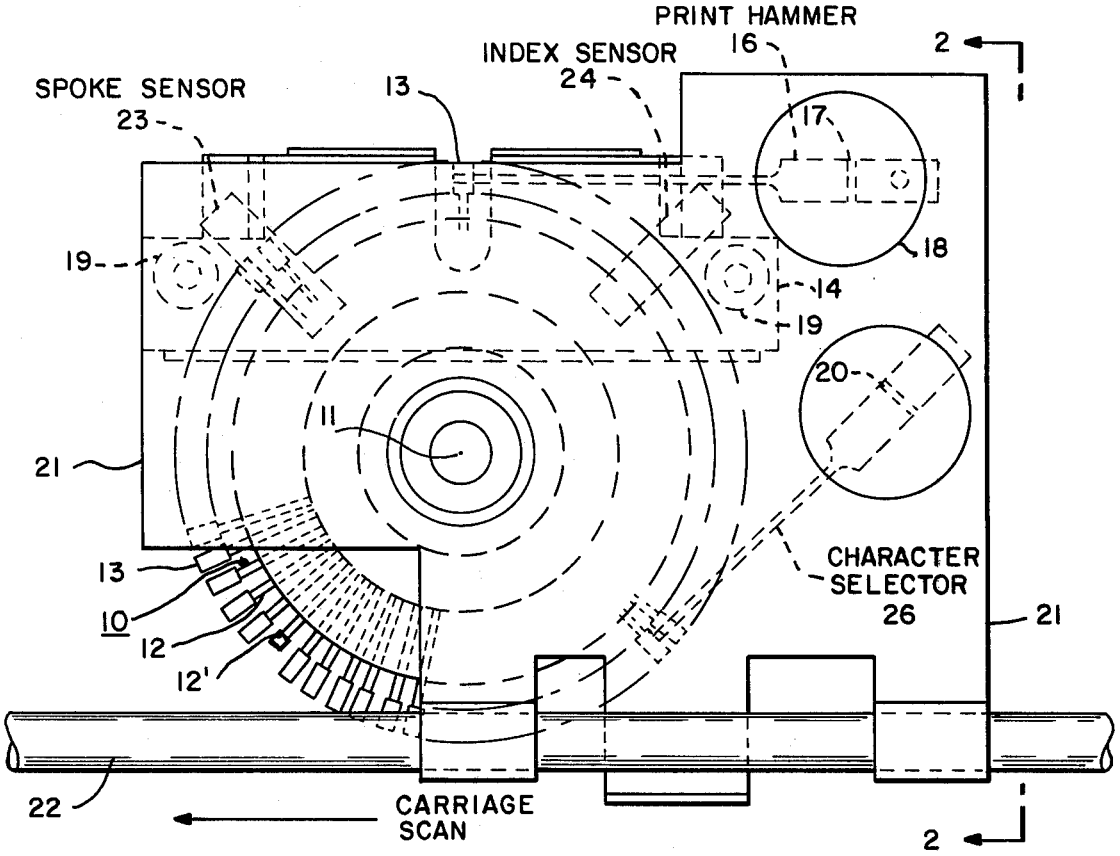
FIG. 1 is a plan view of apparatus of one embodiment of the present invention.
Figure 2:
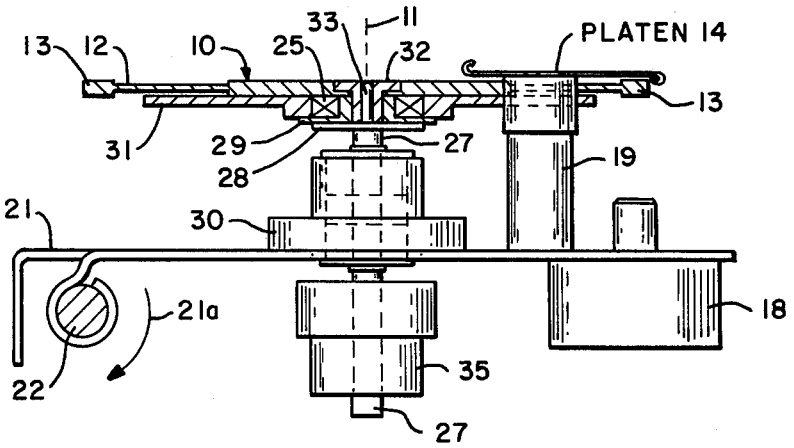
FIG. 2 is substantially taken along the line 2—2 of FIG. 1 and shows a portion of the device in section for clarity.

FIG. 1 in combination with the cross-section of FIG. 2 illustrates one embodiment of the invention with a typical daisy wheel 10 mounted for rotation on an axis 11 extending from a base 21. The daisy wheel or print wheel has radially extending spokes 12 extending from axis 11 with print elements 13 carried on the end of each spoke.

As illustrated in FIG. 2 when the print element 13 is opposite a platen 14 paper and ribbon therebetween (not shown) printing occurs by actuation of the print hammer 16 hitting print element 13 and moving it against the ribbon and paper in a manner well-known in the art. Print hammer 16 shown in dashed outline is pivoted at 17 and constitutes a lever which is actually actuated by a print hammer solenoid 18. Such hammer may be almost identical in construction to the type shown in Ragland Pat. No. 3,696,739.

Figure 6:
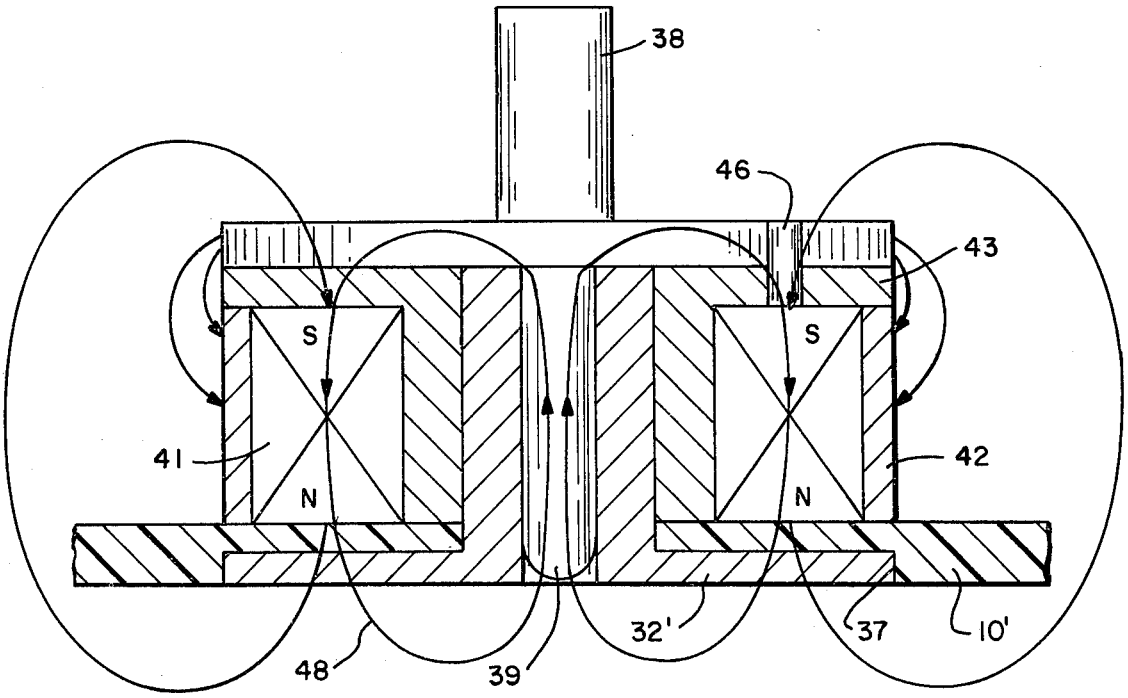
FIG. 6 is an assembled view of some of the parts of FIG. 5.

Platen 14 is retained on a post 19 affixed to the base 21 of the carriage. The carriage itself has a scan along the line of printing to the left in the direction shown and is movable or slidable on the main traverse shaft 22. In order to sense the location of the individual print elements 13 there are provided both a spoke sensor 23 and an index sensor 24. Spoke sensor 23 operates on a photoelectric principle with a light source and a photocathode sensing the passage of each spoke 12. Index sensor 24 indexes the spoke count once each revolution by sensing a short spoke 12'. Such technique is illustrated in FIG. 6 of Wagner Pat. No. 3,669,237 entitled "Double Helical Printer".

In order to brake the rotation of print wheel 10 a character selector lever 26 is mounted on the base 21 and pivoted at point 20. As will be discussed in detail below the character selector engages the spokes 12 or printing elements 13 to stop the wheel. When this occurs a drive shaft 27 driving the print wheel 10 continues to rotate. However, a slipping action is provided by means of an annularly shaped permanent magnet 25 as shown in FIG. 2. This is mounted for rotation with shaft 27 which is, of course, coaxial with the axis 11, by means of a disk 28 of magnetic material affixed to and extending from shaft 27. Disk 28 has affixed to itself in turn a T-shaped insert 29 of non-magnetic copper material which finally is affixed to a backing plate 31 to which permanent annular ring 27 is affixed. In other words, rotating with print wheel shaft 27 as a unit is the metal disk 28, copper insert 29, print wheel backplate 31 and permanent magnet 25. Drive shaft 27 is journaled in bearings 30 on base 21 and driven by a pulley 35.

Print wheel 10 is composed of light-weight plastic material except for a T-shaped metal insert 32 of magnetic material such as cold rolled steel. Insert 32 is journaled on a narrow stub end 33 of shaft 27 so that print wheel 10 and its insert 32 may be pulled off or easily removed from the rest of the assemblage. One benefit of this is the replacement of the print wheel with, for example, one having a different character font. More importantly, however, as discussed above when the spokes 12 of the print wheel are engaged by character selector 26 it allows the stopping of print wheel 10 while the shaft 27 and its drive motor (not shown) may continue to rotate. When the brake is released the print wheel can immediately again resume its rotation for the next printing position due to the magnetic coupling force established between drive shaft 27 and print wheel 10. Specifically this is accomplished by a magnetic field path starting from one pole of magnet 25 to the metal insert 32, through the steel magnetic stub end 33, through disk or plate 28 back to the other pole of magnet 25. Magnet 25 is polarized north-south in the axial direction as is apparent. The copper spacer 29 allows for control of the magnetic coupling force and at the same time the copper material serves as a good bearing surface since the T-shaped insert 32 is stopped while the insert 29 is still being rotated by shaft 27.

The entire carriage on its base 21 may be rotated downward from platen 14 for repair, inspection, replacement of the print wheel 10, etc. in the direction shown by the arrow **21*a* in FIG. 2**.

Figure 3:
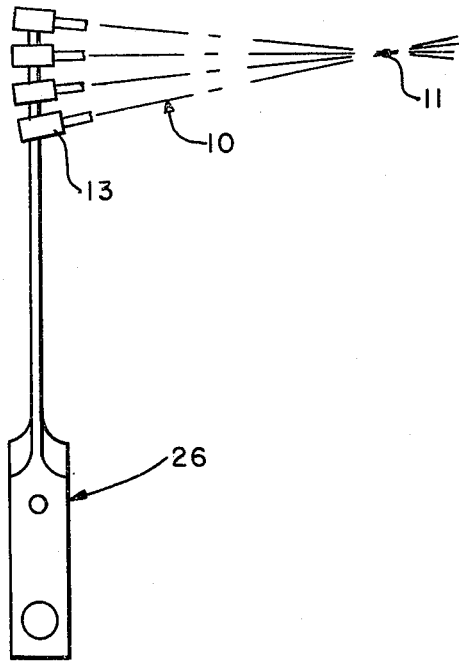
FIG. 3 is a detailed view of a portion of FIG. 1.
Figure 4:
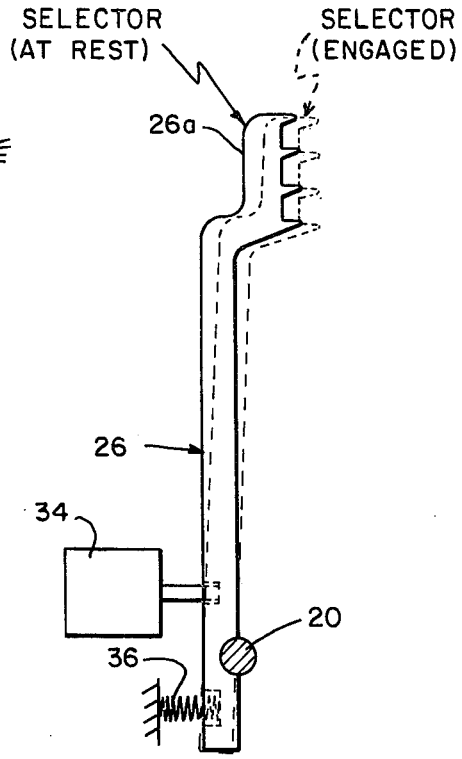
FIG. 4 is a side view of FIG. 3.

FIGS. 3 and 4 illustrate character selector 26 in greater detail. As shown in both of the figures the end **26*a* of the selector has four teeth which intersect effectively with the spokes or character elements 13 of the print wheel 10. By intercepting the print wheel spokes at their extreme ends the greatest leverage is accomplished. FIG. 4 shows the technique of rotating the selector from its rest position in solid outline to its activated or stopping position in dashed outline. This is accomplished by pivoting the selector around the axis 20 by means of a solenoid 34 which acts against a spring 36**. As discussed above this technique has been disclosed in the above Ragland patent.

Figure 5:
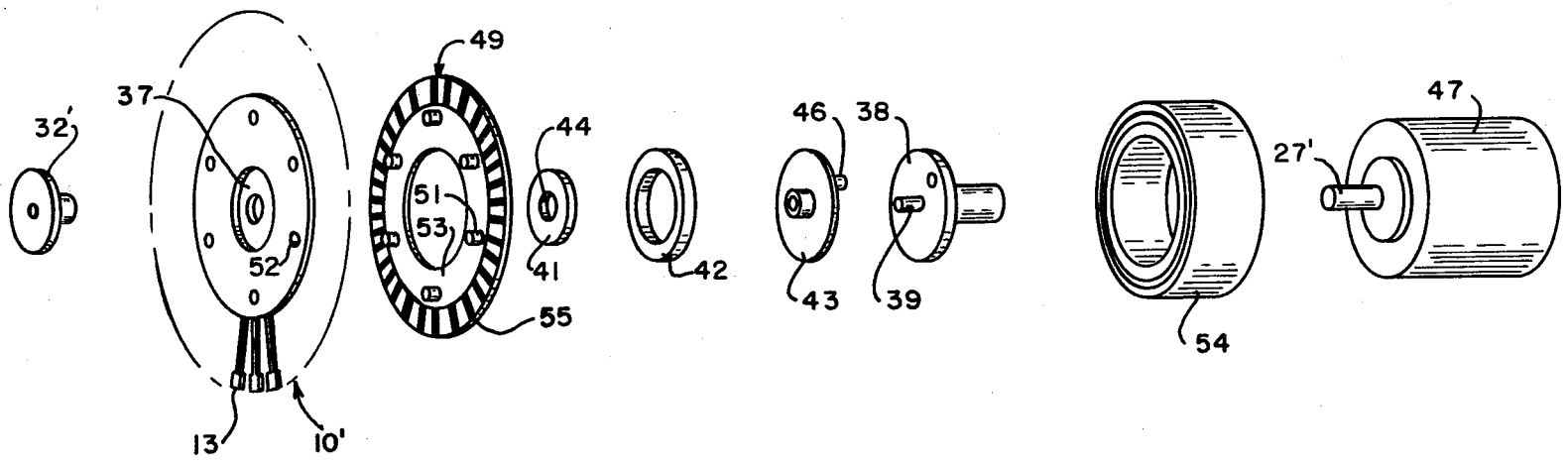
FIG. 5 is an exploded view of a portion of another embodiment of the invention.

Another embodiment of the invention is illustrated in FIG. 5 in exploded view where a daisy type print wheel 10' has a T-shaped metal insert 32' of magnetic material press fitted into a recess 37. FIG. 6 shows a simple cross sectional view of at least the magnetic coupling force structure which couples the drive shaft 27' to the print wheel 10'.

Referring to both figures, a drive spindle 38 has a narrowed end 39 on which insert 32' is journaled for rotation. Permanent magnet 41 is press fit in an aluminum collar 42 and polarized north south across its axis. In the same manner as illustrated in FIG. 2 with the other embodiment of the invention, a brass bearing and magnetic spacer T-shaped unit 43 is press fit into the inner aperture 44 of magnet 41 serving both as a bearing and as a magnetic spacer to control the magnetic field. The steel drive spindle 38 with its narrowed stub end 39 is mated to bearing 43 by a pin 46 so no relative rotational movement can occur between them. Finally spindle 38 is fixed to drive motor shaft 27' driven by drive motor 47.

Thus to summarize, the steel drive spindle 38 brass bearing and magnetic spacer 43, aluminum collar 42, and permanent magnet 41 are all driven as a common unit by drive shaft 27'. A magnetic coupling force is provided as illustrated in FIG. 6 by the magnetic field lines 48 which extend out of the north pole through the insert 32' through the end 39 of the steel drive spindle 38, through the magnetic spacer 43 and into the south pole of magnet 41. Thus far this embodiment is almost identical to that of FIG. 2.

However, the braking action is different. Specifically, an annular portion 49 of magnetic material, such as cold rolled steel is affixed to the daisy wheel 10' by several pins 51 extending from one surface thereof which fit into the mating apertures 52 carried by print wheel 10'. An inner ring portion 53 acts as a braking surface when it is attracted by the cup type electromagnetic brake or ring solenoid 54. The pin arrangement 51, 52 allows a slight axial displacement of annular portion 49 carried by the print wheel for stopping the print wheel rotation.

An outer ring 55 having bars marked thereon provides an indexing function to locate the position of the daisy wheel. This location may provide greater flexibility in locating photoelectric apparatus as compared to the other embodiment of the invention.

Figure 8:
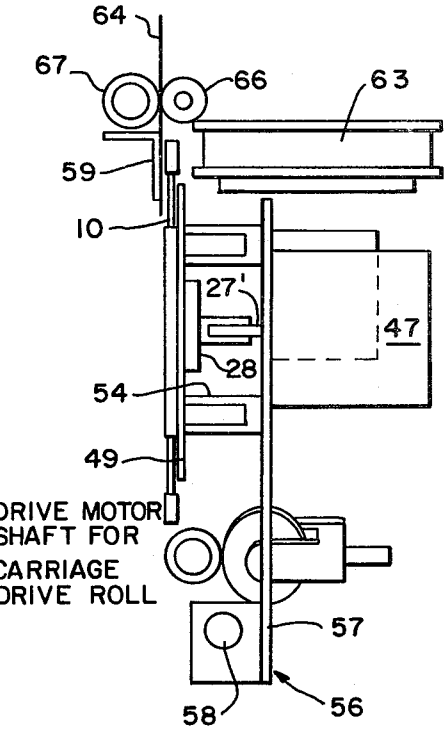
FIG. 8 is a side view of FIG. 7.
Figure 7:
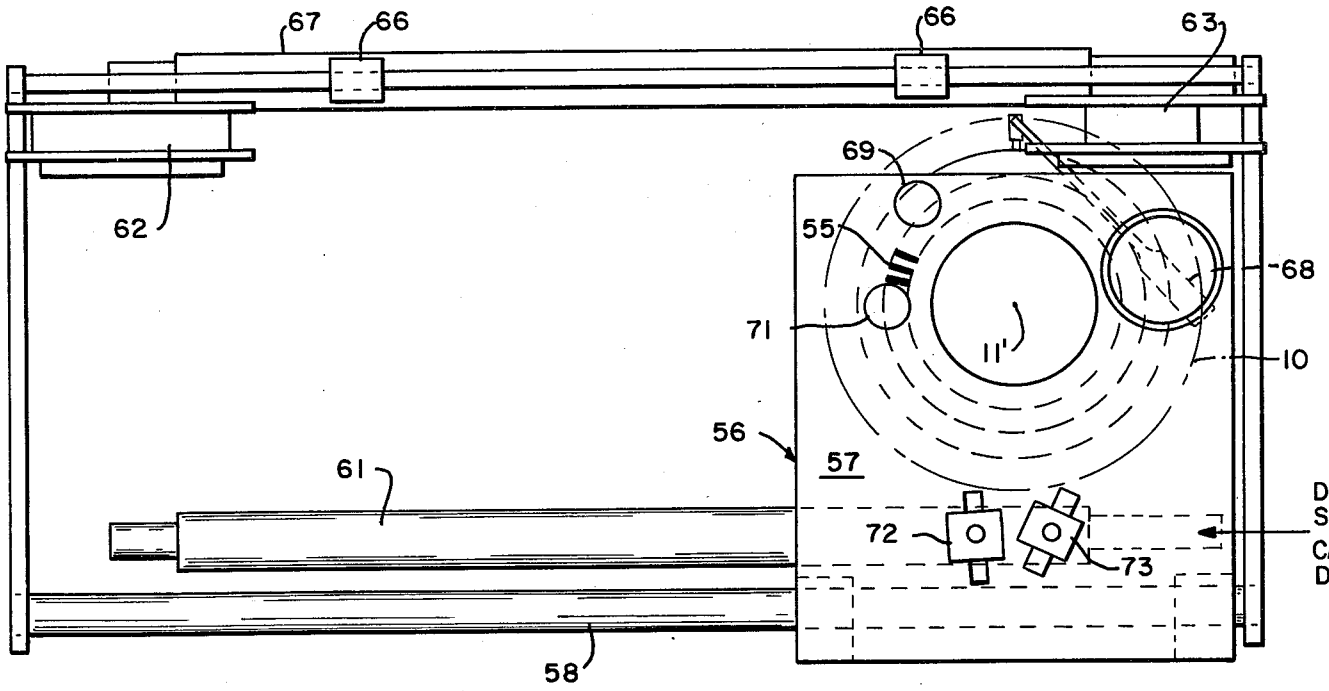
FIG. 7 is an elevation view showing the embodiment of FIGS. 5 and 6 in the practical printing apparatus.

FIGS. 7 and 8 and especially FIG. 8 show the action of the cup type electromagnetic brake 54 more clearly. The plan view of FIG. 7 in conjunction with the side view of FIG. 8 illustrates the use of this embodiment in actual printing apparatus. A carriage 56 has a metal base plate 57 on which all of the elements shown in FIG. 5 are mounted. Carriage 56 moves on a main traverse shaft 58. Also the entire carriage may be moved downward away from the fixed platen 59 to allow for access. The scan is normally from right to left and is provided by carriage drive roller 61 which is of a hard rubber material. The ribbon supply and take-up reels 62, 63 provide the ribbon for the printing. As illustrated in FIG. 8, paper 64 is held between a pressure roller 66 and a paper drive roller 67. A hammer lever 68 is provided similar to that in the other embodiment. In addition photoelectric devices 69 and 71 scan the ring 55 to provide for indexing and counting functions.

Figure 9A:
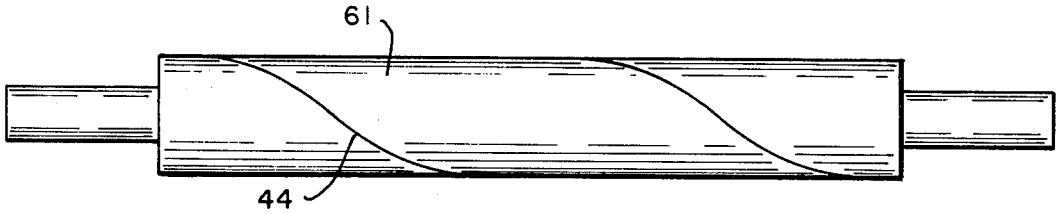
FIGS. 9A and 9B are a portion of FIG. 7 to better illustrate its operation.
Figure 9B:
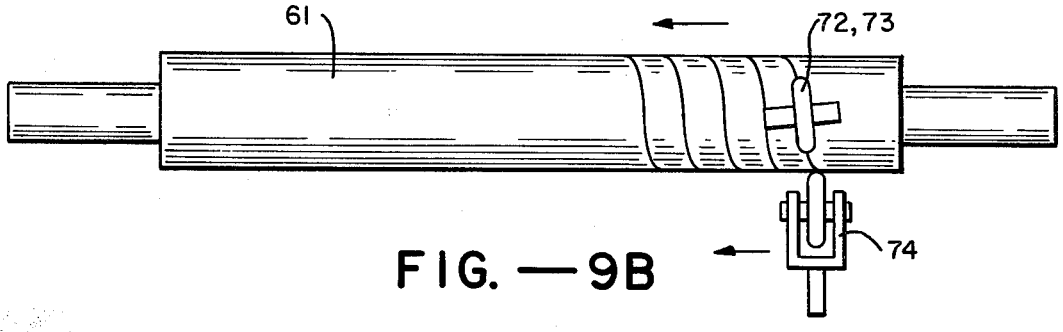

The means for scanning the carriage as well as including the drive roll 61 also include a friction wheel shown in print and return positions 72 and 73, respectively. This is shown more clearly in FIGS. 9A and 9B where friction wheel 72, 73 rotates on the roll 61 and describes a helical path 74 depending on the angle of the wheel itself. FIG. 9B illustrates a typical holder 74 on which wheel 72, 73 is journaled so that the pitch at which the wheel is set may be effectively changed. In other words, in FIG. 7 the return pitch indicated at 73 is much greater than the print pitch indicated at 72 to thus provide for a reasonably low scan movement during printing and a fast return. And, of course, the direction of pitch whether it is positive or negative provides for movement in one direction or the reverse direction.

Figure 10:
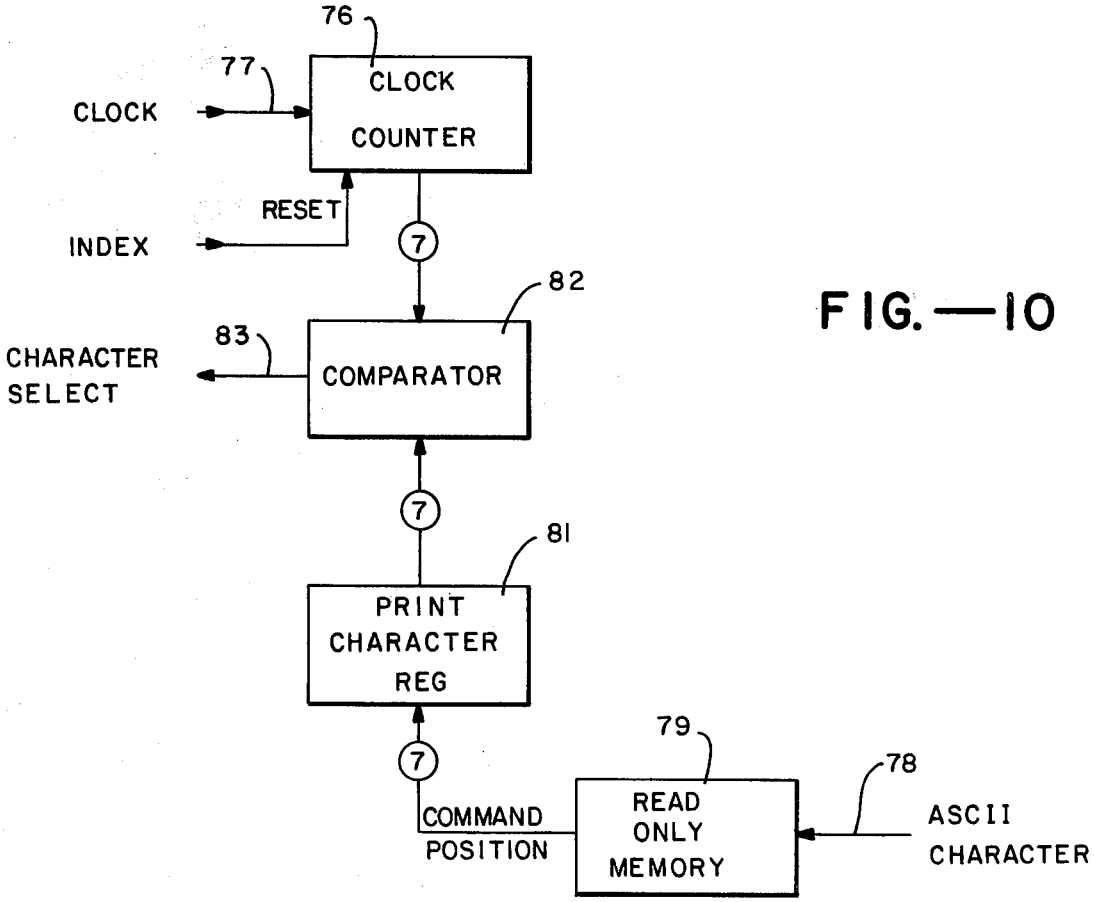
FIG. 10 is a block diagram illustrating the operation of both embodiments of the invention.

In operation since the hammer and carriage are actuated or moved at constant rates recovery problems are minimized. The variable factor illustrated in FIG. 10 is the character select function which actuates the selector lever. This is true in both embodiments of the invention. Moreover since the selector lever, in the case of the first embodiment, is of relatively light-weight aluminum and the select or brake function in the other embodiment is a cup-type electromagnetic type brake these braking mechanisms can easily be varied in time. The circuit of FIG. 10 for actuating this character select function includes a basic clock counter 76 or timer receiving a clock input on line 77. An ASCII character to be printed is inputed on line 78 to a read-only memory where it is translated to a command position on a seven line input to a print character register 81. The actual print character sequence is based on ASCII sequence but instead of merely having an "alpha stick" and a "numeric stick" the 48 different possible characters are divided into four sticks by arrangement of the binary logic so that if the next character selected is within 16 positions of the last character previously printed the print wheel will rotate fully another time and assures the select unit has time for recovery.

The output of the print character register 81 is compared in a comparator 82 to the clock counter which is rest by an index to the print wheel and when the two inputs coincide a select command occurs on line 83. As discussed above, in the case of the embodiment of FIG. 8 the electromagnet 54 is energized and in the case of the embodiment of FIG. 1 the character selector 26 is actuated. In order to provide for effective character selection the period of rotation of the print wheel must be less than the time required between print hammer actuations. In other words, the print wheel must rotate at a fast enough speed so that a character may be selected well before the print hammer is periodically actuated. For example, assume a character density of ten characters per inch with a scan rate of five inches per second. This is in effect a printing rate of 50 characters per second or the time for selection is less than 20 milliseconds. Assuming the print wheel has a rotation of 3,600 revolutions per minute a single rotation will occur 1/60 of a second or 16.5 milliseconds which is less than the 20 millisecond time between effective print hammer actuations.

Figure 11:
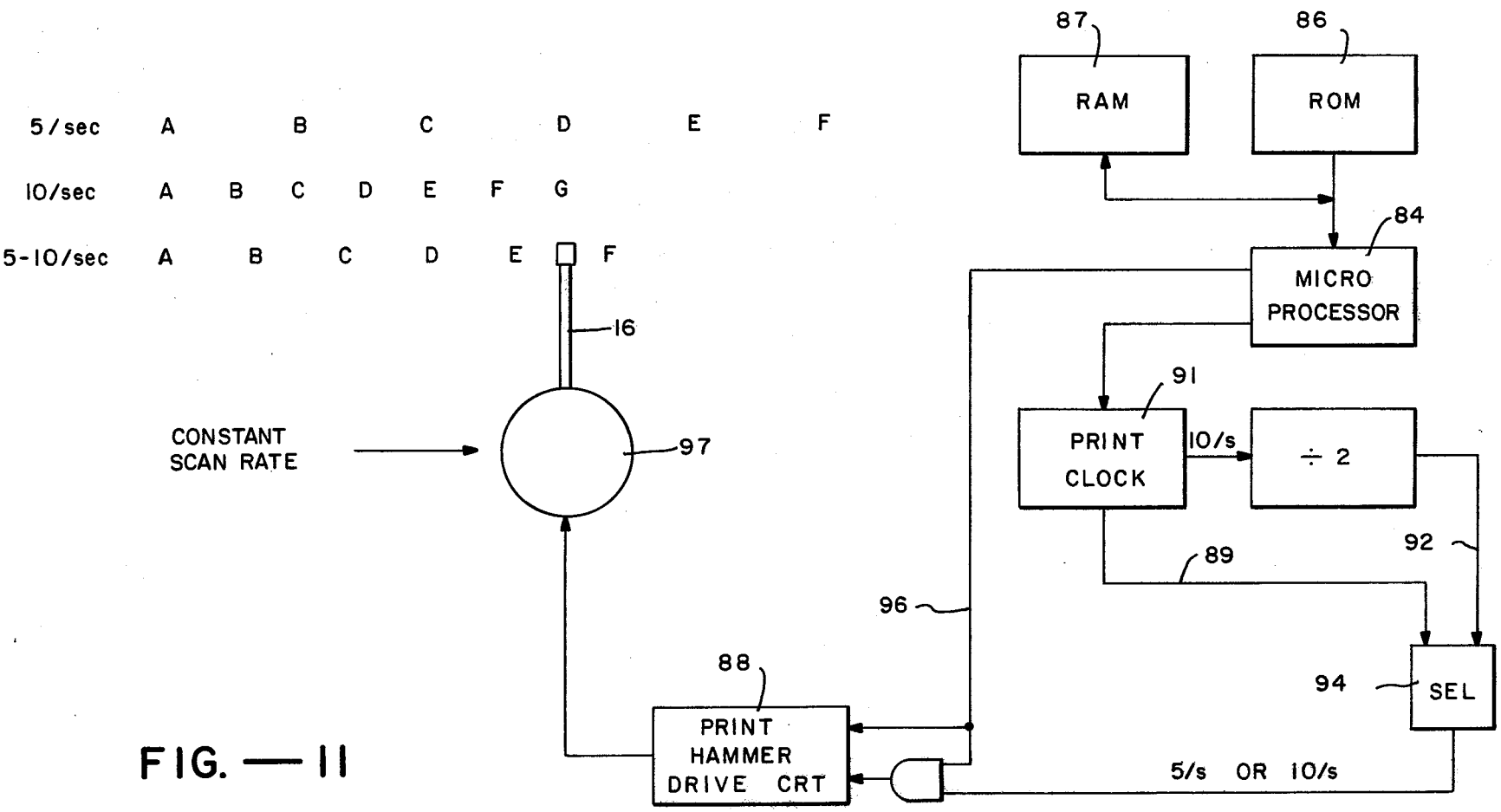
FIG. 11 is a block diagram along with a typical print format illustrating the operation of the invention.

Moreover, by varying the constant rate of the print hammer actuation to another constant rate as illustrated in FIG. 11 proportional spacing may be achieved. This is accomplished with the use of a microprocessor 84 which has both a ROM read only memory input 86 and a random access memory input 87. Random access memory 87 would typically contain a line of, for example, 32 characters. Depending on how many characters were actually to be printed the print hammer drive circuit 88 can be varied between a ten character per second output on line 89 from the print clock 91 or a five per second rate on line 92 from the divide-by-two unit 93 which is connected to print clock 91. A selector 94 determines which of the rates is to be selected. Thus the density is doubled as illustrated by the five per second print line compared to the ten per second print line. Assuming different spacing is desired a control line 96 from microprocessor 94 drives the print hammer circuit 88 to provide an intermediate hammer actuation rate. The carriage is schematically indicated at 97 which carries the print hammer and, of course, has a constant scan rate.

What is claimed is:

1. Printing apparatus comprising: a daisy type print wheel including a plurality of print elements carried on spokes radiating out from the wheel axis such print elements being oriented to lie in a plane perpendicular to said axis and including a fixed portion of magnetic material; means for rotating said wheel around its axis including drive shaft means; print hammer means adapted to impact a selected print element while such element is stopped; magnet means producing a magnetic field mounted for rotation with said drive shaft means and said wheel; brake means separate from said print hammer means and having only a single movable component which interfaces with said print wheel, for acting on said wheel for stopping its rotation and selecting one of said print elements for positioning such element to be hit by said hammer means; magnetic material means connected to said drive shaft means and juxtaposed with said magnet means and rotatable with said fixed wheel portion in a physical relationship to provide a substantial magnetic coupling force between said wheel and said drive shaft means and for allowing said wheel and shaft means to have relative rotary motion therebetween when said brake means is actuated.

2. Apparatus as in claim 1 said brake means include a selector lever pivoted on a fixed fulcrum and having a toothed end for selectively engaging a plurality of said spokes for stopping wheel rotation.

3. Apparatus as in claim 1 where said brake means include annular electromagnetic means for attracting, when energized, a magnetic annular portion carried by said print wheel for stopping its rotation.

4. Apparatus as in claim 3 including means for affixing said annular portion to said print wheel to prevent relative rotation therebetween but to allow relative axial movement.

5. Apparatus as in claim 4 wherein said affixing means includes pins extending from said annular portion and mating apertures in said print wheel.

6. Apparatus as in claim 1 where said magnet means includes a ring shaped permanent magnet magnetized in its axial direction and with one magnetic pole in proximity to said fixed portion of said wheel and the other pole in proximity to said magnetic material means connected to said drive shaft means.

7. Apparatus as in claim 1 where said drive shaft means includes magnetic material for providing a magnetic path between said fixed portion of said wheel and said magnetic material means connected to said drive shaft means.

8. Apparatus as in claim 1 including hammer means for hitting a print element of said print wheel including print clock means for actuating said hammer at a constant rate.

9. Apparatus as in claim 8 where the shaft means rotates the said print wheel at a rotary speed having a period less than the time between print hammer actuations.

10. Apparatus as in claim 8 including a carriage for carrying said print wheel and drive means for moving said carriage linearly along a predetermined path at a constant speed and together with means for changing said constant rate of said hammer actuation to provide a change in spacing.

11. Apparatus as in claim 1 including a carriage for carrying said print wheel; and drive means coupled to said carriage for moving said carriage linearly along a predetermined path such means including a drive roller driven at a constant speed and having a length coextensive with said path and a friction wheel pivotally mounted to said carriage and engaging said drive roller at at least one predetermined angle to provide a constant speed of carriage movement proportional to said angle.

12. Apparatus as in claim 11 where said predetermined angle is an effective positive pitch and including means for rotating said friction wheel to provide an effective negative pitch and thereby reverse the direction of said carriage movement.

13. Apparatus as in claim 12 where said negative pitch is relatively larger than said positive pitch to provide a fast carriage return.

14. Apparatus as in claim 1 together with nonmagnetic means interposed between said magnet means and said magnetic material means connected to said drive shaft means for controlling said magnetic coupling force.

15. Apparatus as in claim 14 where said nonmagnetic means provide a bearing surface when said print wheel is stopped.

* * * * *

Disclaimer and Dedication 4,128,346.—*Evan L. Ragland, III,* Atherton, Calif. DAISY TYPE PRINT WHEEL APPARATUS Patent dated Dec. 5, 1978. Disclaimer and Dedication filed Dec. 22, 1981, by the assignee, *Periphonic Corp.*

Hereby disclaims and dedicates to the Public the remaining term of said patent.

[*Official Gazette March 23, 1982.*]